US006580218B2

(12) United States Patent
Harada et al.

(10) Patent No.: US 6,580,218 B2
(45) Date of Patent: Jun. 17, 2003

(54) DISCHARGE TUBE

(75) Inventors: Nobuharu Harada, Hamamatsu (JP); Syoji Ishihara, Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 0 days.

(21) Appl. No.: 09/986,406

(22) Filed: Nov. 8, 2001

(65) Prior Publication Data

US 2002/0027419 A1 Mar. 7, 2002

Related U.S. Application Data

(63) Continuation-in-part of application No. PCT/JP00/03054, filed on May 12, 2000.

(30) Foreign Application Priority Data

May 12, 1999 (JP) ..... 11-131839

(51) Int. Cl.[7] ..... H01J 17/04
(52) U.S. Cl. ..... 313/631; 313/632; 313/633
(58) Field of Search ..... 313/631, 632, 313/633, 491

(56) References Cited

FOREIGN PATENT DOCUMENTS

| | | |
|---|---|---|
| JP | 60-131751 | 7/1985 |
| JP | 61-90157 | 6/1986 |
| JP | 63-24539 | 2/1988 |
| JP | 64-24355 | 1/1989 |
| JP | 1-213952 | 8/1989 |
| JP | 8-273622 | 10/1996 |
| JP | 9-92201 | 4/1997 |
| JP | 9-129179 | 5/1997 |
| JP | 11-288689 | 10/1999 |

*Primary Examiner*—Vip Patel

(57) ABSTRACT

A discharge tube in which a cathode with a cathode tip portion being fixed to a lead rod and an anode opposed to the cathode tip portion are encapsulated in a discharge gas atmosphere to effect arc discharge, wherein the cathode tip portion comprises: a metal substrate of an impregnated type in which a porous, refractory metal is impregnated with an electron-emissive material or a sintered type in which a refractory metal containing an electron-emissive material is sintered; and a coating of a refractory metal covering a predetermined portion in a surface of the metal substrate and having a thickness of not less than 0.02 μm nor more than 5 μm, wherein the metal substrate has a cusp pointed toward the anode, and wherein a tip portion of the cusp of the metal substrate is exposed without being covered by the coating.

5 Claims, 3 Drawing Sheets

DISCHARGE TUBE

RELATED APPLICATIONS

This is a Continuation-In-Part application of International Patent application Ser. No. PCT/JP00/03054 filed on May 12, 2000, now pending.

BACKGROUND OF THE INVENTION

1. Field of the Invention

The present invention relates to a discharge tube and, more particularly, to a discharge tube used as a light source such as a xenon short arc lamp, a mercury-xenon lamp, or the like.

2. Related Background Art

For example, the official gazette of Japanese Patent Application Laid-Open No. H01-213952 is a document that describes the technology concerning the discharge tube for effecting arc discharge between electrodes placed in a glass bulb. This gazette discloses the discharge tube in which an entire surface of a metal substrate is covered with a refractory metal like iridium so as not to expose a surface of a cusped tip of the metal substrate (emitter portion) containing an electron-emissive material like barium. The gazette also describes that it is feasible to stabilize the arc and decrease fluctuation of the arc, because the entire surface of the emitter portion is covered by a thin film of the refractory metal.

SUMMARY OF THE INVENTION

However, the technology described in the above gazette had the following problem. Namely, when the entire surface of the metal substrate containing barium is covered with iridium, barium cannot serve as an electron-emissive material at low operating temperatures. For this reason, the operating temperatures of the discharge tube must be kept high, so as to increase evaporation amounts of electrode materials, which will result in shortening the lifetime of the discharge tube.

The present invention has been accomplished under such circumstances and an object of the invention is to provide a discharge tube that can operate at low operating temperatures on a cathode for inducing arc discharge, thereby lengthening the lifetime.

In order to solve the above problem, the present invention provides a discharge tube in which a cathode with a cathode tip portion being fixed to a lead rod and an anode opposed to the cathode tip portion are encapsulated in a discharge gas atmosphere to effect arc discharge, wherein the cathode tip portion comprises a metal substrate of an impregnated type in which a porous, refractory metal is impregnated with an electron-emissive material or a sintered type in which a refractory metal containing an electron-emissive material is sintered, and a coating of a refractory metal which covers a predetermined portion in a surface of the metal substrate and which has a thickness of not less than 0.02 $\mu$m nor more than 5$\mu$m, wherein the metal substrate has a cusp pointed toward the anode, and wherein a tip portion of the cusp of the metal substrate is exposed without being covered by the coating.

In the discharge tube according to the present invention, the metal substrate of the cathode tip portion containing or impregnated with the electron-emissive material is covered in the predetermined portion by the coating of the refractory metal having the thickness of not less than 0.02 $\mu$m nor more than 5 $\mu$m, whereby the electron-emissive material is prevented from being evaporated in the coating part during operation of the discharge tube. On the other hand, the tip portion of the cusp of the metal substrate is exposed without being covered by the coating, which promotes emission of electrons from the electron-emissive material having diffused to the tip portion. For this reason, electrons can be efficiently emitted at relatively low temperatures, which can stabilize the discharge and which can also suppress the evaporation of the electron-emissive material, thus lengthening the lifetime. The inventors conducted intensive and extensive research and found that the lifetime of the discharge tube was able to be lengthened when the thickness of the coating covering the metal substrate was controlled in the range of not less than 0.02 $\mu$m nor more than 5 $\mu$m. Namely, when the thickness is smaller than 0.02 $\mu$m, the coating reduces its effect of preventing the evaporation of the electron-emissive material. On the other hand, when the thickness is larger than 5 $\mu$m, the coating becomes easier to peel off the metal substrate, so as to shorten the lifetime of the discharge tube.

The thickness of the coating is desirably selected in the range of not less than 0.2 $\mu$m nor more than 3 $\mu$m. In this case, it becomes feasible to further enhance the effect of preventing the evaporation of the electron-emissive material and almost nullify the possibility of peeling-off of the coating from the metal substrate.

The present invention will become fully understood from the detailed description and accompanying drawings which will follow. It is to be considered that these are presented merely for illustration of the invention but do not limit the present invention.

DESCTIPRION OF THE PREFERRED EMBODIMENTS

A preferred embodiment of the discharge tube according to the present invention will be described below in detail with reference to the accompanying drawings. The same elements will be denoted by the same reference symbols and redundant description will be omitted.

Figure 1:
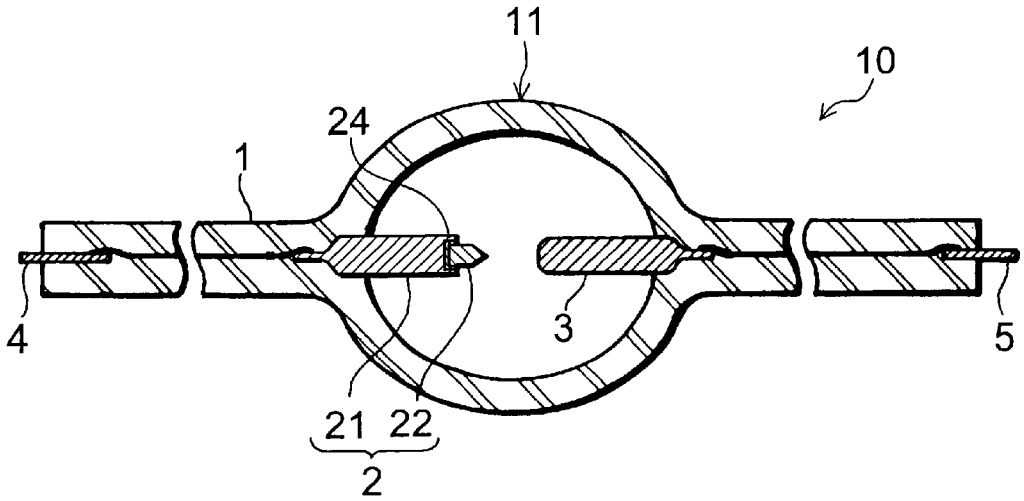
FIG. 1 is a cross-sectional view showing the structure of a discharge tube (xenon short arc lamp) according to the present invention.

FIG. 1 is a longitudinal, cross-sectional view showing the structure of the xenon short arc lamp (discharge tube) 10 in the present embodiment. A hollow gas enclosure 11 is formed in a middle portion of a quartz glass bulb 1 making a container of the short arc lamp 10, and the interior of the gas enclosure 11 is filled with a discharge gas like xenon. A cathode 2 and an anode 3 are opposed to each other inside the gas enclosure 11, and external terminals 4, 5 electrically connected respectively to the cathode 2 and to the anode 3 are attached to two ends of the glass bulb 1. The cathode 2 has a molybdenum lead rod 21 a base portion of which is fixed to the glass bulb 1, and a cathode tip portion 22 a base portion of which is fixed to a distal end of the lead rod 21.

Figure 2:
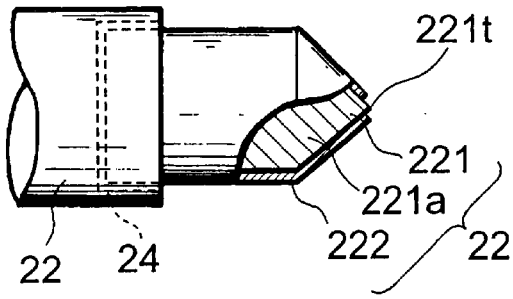
FIG. 2 is a side view of the cathode the cathode tip portion of which is partly broken.

FIG. 2 is a side view of the cathode 2 the cathode tip portion 22 of which is partly broken. The cathode tip portion 22 is composed of a metal substrate 221 having a cusp 221*a* of circular cone shape pointed toward the anode 3, and a metal coating 222 which covers portions except for a tip portion 221*t* of the cusp 221*a* in the metal substrate 221, i.e., a slope of the cusp 221*a* and a cylindrical portion on the base side of the cathode tip portion 22. The metal substrate 221 is made by impregnating porous tungsten (refractory metal) with barium (electron-emissive material), and the metal coating 222 is made of iridium (refractory metal) as deposited by CVD. The cathode tip portion 22 of this structure is fixed to the lead rod 21 with solder 24.

The metal coating 222 has the thickness of not less than 0.02 $\mu$m nor more than 0.5 $\mu$m, and can also be formed by sputtering or the like, instead of CVD. In the cathode tip portion 22, the nearer to the tip portion 221*t* of the cusp 221*a*, the higher the temperature becomes during operation of the short arc lamp 10; and the nearer to the tip portion 221*t*, the more important the role in diffusing the electron-emissive material. Accordingly, the metal coating 222 is an indispensable element on the cusp 221*a*, but there will occur no trouble even if the metal substrate 221 is exposed on the side surface of the cylindrical base.

Preferably, as described above, the metal substrate 221 is exposed without presence of iridium as the metal coating 222, at the tip portion 221*t* of the cusp 221*a* in the cathode tip portion 22. This structure can be accomplished, for example, by depositing iridium over the entire surface and thereafter removing iridium from the tip portion 221*t* by polishing with sandpaper. In another method, iridium can be removed from the tip portion 221*t* by so-called ablation to irradiate it with a pulsed laser beam. In still another method, iridium is deposited with a mask on the tip portion 221*t* whereby the metal substrate 221 containing the electron-emissive material is exposed at the tip portion 221*t*.

Further, it is also possible to adjust the thickness and deposition conditions of the metal coating 222 so as to make the metal coating 222 physically "weaker" at the tip portion 221*t* than at the other portions, assemble the discharge tube, and thereafter effect weak predischarge, thereby selectively removing iridium from the tip portion 221*t* so as to expose the metal substrate 221. This predischarge can be carried out by supplying dc or ac power, but it may also be implemented as a part of so-called aging.

At the tip portion 221*t* of the cusp 221*a*, the metal substrate 221 is preferably exposed without presence of iridium in the discharge gas atmosphere, but the excellent effect of the present embodiment can be generally demonstrated as long as the metal substrate is exposed in a substantial sense even if not exposed completely. The phrase "exposed in a substantial sense" stated herein means that the electron-emissive material diffusing inside the metal substrate 221 is in a state in which it is exposed to the discharge gas upon arrival at the tip portion 221*t*. In other words, a first condition is that during the operation the electron-emissive material is in a material state in which it can sufficiently diffuse to the surface of the tip portion 221*t* of the metal substrate 221, and a second condition is that the tip portion 221*t* is in a material state in which the electron-emissive material can be kept in contact with the discharge gas, in a density approximately several times to several ten times that on the metal coating 222 formed on the conical slope of the cusp 221*a*.

Describing it from the microscopic aspect, for example, even if at the tip portion 221*t* fine iridium grains are scattered in an island pattern, the electron-emissive material like barium can be readily supplied to the exposed surface of the metal substrate 221 at the tip portion of the cusp to facilitate emission of electrons into the discharge gas. At this time, since the metal substrate 221 is covered by the metal (iridium) coating 222 on the conical slope of the cusp 221*a*, the evaporation of the electron-emissive material is prevented there.

From the microscopic view of the metal coating 222, it is a film in which a number of fine iridium grains having particle sizes of several ten to several hundred angstrom order are stacked at random. Supposing the thickness of the deposition of iridium grains at the tip portion 221*t* is a fraction of several to several tens of that on the conical slope of the cusp 221*a*, it can be mentioned that the metal substrate 221 at the tip portion 221*t* is in a "substantially exposed" state, in view of the relativity between the conical slope and the tip portion 221*t*. Further, the iridium grains may be deposited in different sizes or in different deposition densities. For example, the grain sizes are made large at the tip portion 221*t* and the grain sizes small on the conical slope, which can prevent the electron-emissive material in the metal substrate 221 from being evaporated on the conical slope and which can readily supply electrons into the discharge gas via the electron-emissive material having diffused to the tip portion 221*t*.

Here the refractory metal forming the metal substrate 221 needs to be a metal that resists deterioration and deformation at high temperatures during the operation and that can contain the electron-emissive material by impregnation or sintering. Such a metal can be selected from molybdenum, tantalum, and niobium, as well as tungsten, and tungsten is a most preferable metal in either of the impregnated type and the sintered type.

The electron-emissive material, which is contained in the metal substrate 221 or with which the metal substrate 221 is impregnated, needs to be a metal having a low work function and readily emitting electrons and, desirably, it is one resistant to evaporation under high temperatures. Such a material can be one selected from the alkaline earth metals such as calcium, strontium, etc., as well as barium, and from lanthanum, yttrium, cerium, and so on. The material can be a mixture of two or more metals, or an oxide.

Further, it is important that the metal forming the metal coating 222 be a refractory metal resistant to the high temperatures during the operation of the short arc lamp 10, and a metal to lower the work function can further promote the emission of electrons from the electron-emissive material. Such a metal is most preferably iridium, and it can also be selected from rhenium, osmium, ruthenium, tungsten, hafnium, and tantalum. The coating can be a mixture of two or more metals, or a laminate film.

Next, the remarkable action and effect of the short arc lamp according to the present embodiment will be described below.

First, procedures of producing the short arc lamp 10 of the present embodiment will be described. The porous metal substrate of tungsten having the diameter of 2.5 mm was first impregnated with barium oxide by a known method and then the coating 222 of iridium was deposited by CVD in the thickness of 2 $\mu$m on the surface of the cusp 221*a* except at the tip portion 221*t* and on the surface of the cylindrical portion, thereby forming the cathode tip portion 22. Then this cathode tip portion 22 was fixed to the lead rod 21 by brazing to form the cathode 2. This cathode 2, together with the anode 3, is mounted in the glass bulb 1, and the interior of the glass bulb 1 is filled with the discharge gas, thereby completing the short arc lamp 10 of 500 W.

Figure 3:
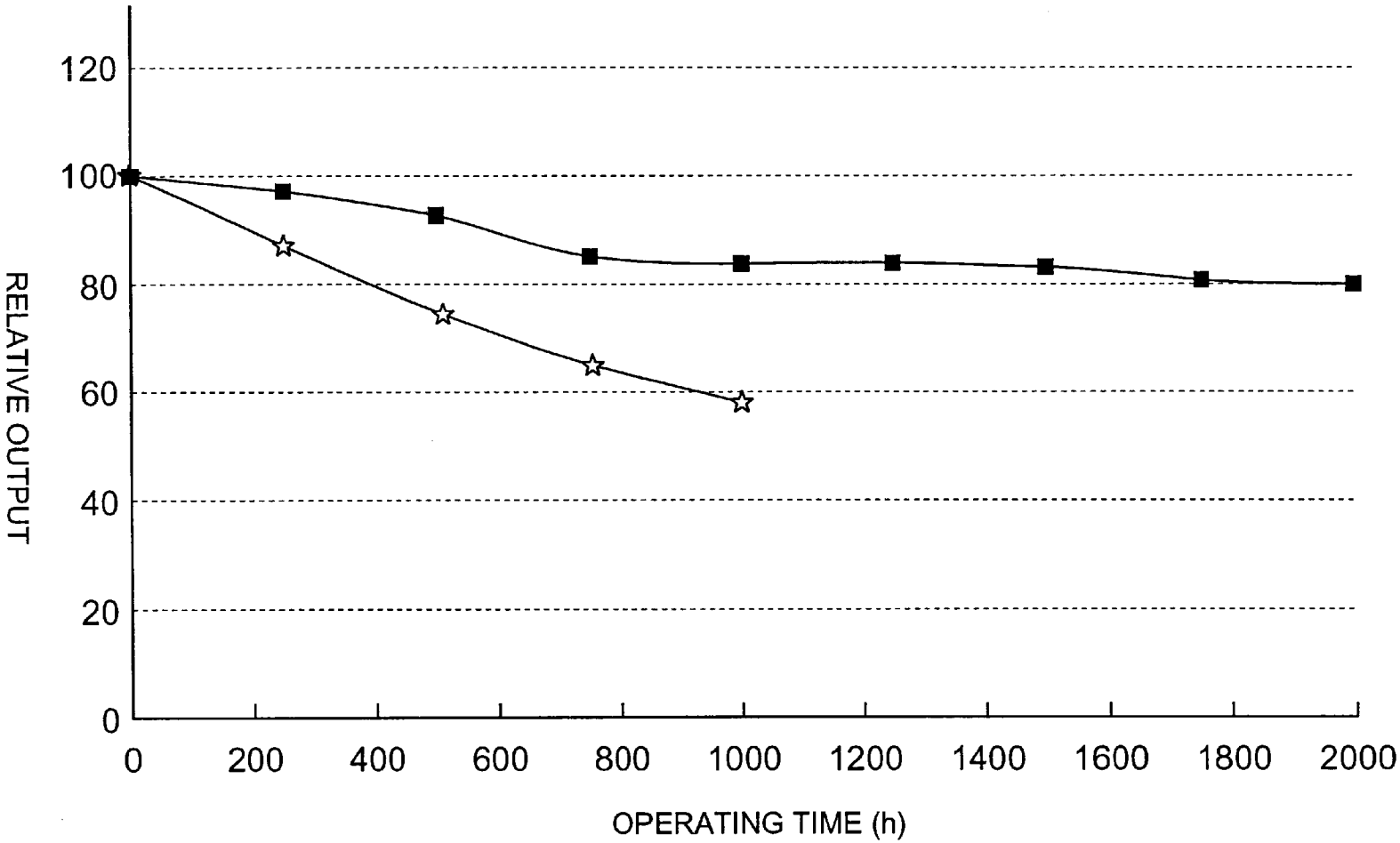
FIG. 3 is a graph showing a relation between operating time and relative output of the discharge tube according to the present invention.

Next, the characteristics of the short arc lamp 10 will be described referring to the graph of FIG. 3. FIG. 3 is the graph showing the relation between operating time of the lamp and relative output of the lamp after completion of 24-hour aging. In this graph, data concerning a lamp of the conventional type without a coating on the metal substrate is indicated by white stars, and data concerning the short arc lamp 10 of the present embodiment by black squares. It is seen from this graph that after 1000-hour operation the conventional lamp decreased its output to about 60% of the initial output, whereas the short arc lamp 10 of the present embodiment can maintain its output at about 80% of the initial output even after 2000-hour operation.

Reasons why the short arc lamp 10 of the present embodiment can maintain its performance over a long period in this way are as follows: first, the metal coating 222 prevents the evaporation of the electron-emissive material in the portions covered by the metal coating 222, i.e., in the portions except for the tip portion 221*t* of the metal substrate 221; second, at the tip portion 221*t* of the cusp 221*a* exposed without being covered by the metal coating 222, electron emission is promoted from the electron-emissive material whereby electrons can be efficiently emitted at relatively low temperatures. This stabilizes the discharge and also suppresses the evaporation of the electron-emissive material, thus realizing lengthening of the lifetime. The above also solves the problem in the foregoing Japanese Patent Application Laid-Open No. H01-213952 that the discharge tube must operate at high temperatures because of the coating over the tip portion of the metal substrate.

Japanese Patent Application Laid-Open No. H09-92201 discloses an arc lamp using a cathode in which a porous metal body containing an electron-emissive material is fitted on the periphery of a porous center electrode containing no electron-emissive material. The arc lamp of this type, however, takes a long time before the electron-emissive material diffuses to the tip of the center electrode during aging. Thus temperatures become considerably high, particularly, at the tip portion of the cusp. For this reason, the porous metal at the tip portion of the cusp becomes deteriorated because of melting, softening, or the like, which can cause failure in adequate diffusion of the electron-emissive material during normal operation. It is not easy to mold two porous metals separately and engage them with each other so as to allow smooth diffusion of the electron-emissive material from the surrounding metal body to the center electrode.

In contrast to it, since in the short arc lamp 10 of the present embodiment the metal coating 222 covers the metal substrate 221 so as to expose the tip portion 221*t* of the metal substrate 221 containing the electron-emissive material as described above, electron emission starts from barium at the tip portion 221*t* in a relatively low temperature state a little higher than 1000° C., and the operating temperatures are kept low. The production is also easy, because there is no need for the process of forming two porous metals separately and then engaging them with each other.

Figure 4:
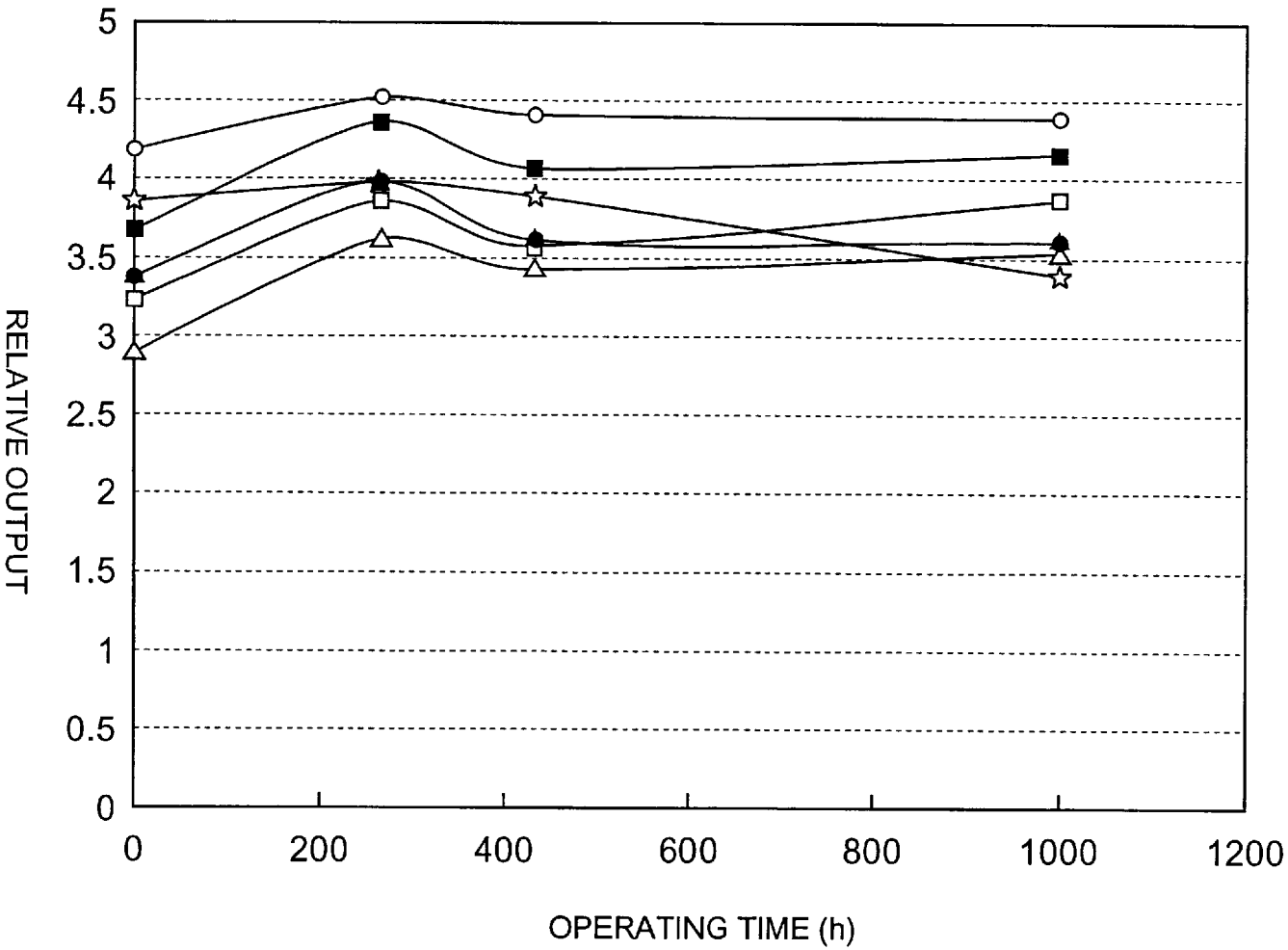
FIG. 4 is a graph showing a relation between operating time of the discharge tube and relative output of the lamp with variation in the thickness of the metal coating covering the metal substrate.

In the next place, the relation between relative output of the lamp and thickness of the metal coating 222 covering the metal substrate 221 will be described referring to FIG. 4. FIG. 4 is the graph showing the relation between operating time of the lamp (200 W) and relative output of the lamp after completion of 24-hour aging.

In this graph, data concerning the conventional short arc lamp without the metal coating on the metal substrate is indicated by white stars. Data concerning short arc lamps of the present embodiment with the metal coating 222 in various thicknesses of 0.02 μm, 0.2 μm, 2 μm, 3 μm, 4 μm, and 5 μm, is indicated by white circles, black circles, black squares, black triangles, white squares, and white triangles, respectively. It is seen from this graph that the conventional lamp lowers the relative output with a lapse of operating hours, but the lamps in which the metal coating 222 covers the portions except for the tip portion 221*t* of the metal substrate 221 as in the present embodiment, demonstrate little decrease in the relative output.

It was also verified from intensive and extensive research by the inventors that the effect of preventing the evaporation of the electron-emissive material by the metal coating 222 was weakened when the metal coating 222 was thinner than 0.02 μm and that when the metal coating 222 was thicker than 5 μm, the metal coating 222 became easier to peel off the metal substrate 221, so as to shorten the lifetime of the lamp. Further, the inventors discovered by experiment that when the thickness of the metal coating 222 was controlled in the range of not less than 0.2 μm nor more than 3 μm, the effect of preventing the evaporation of the electron-emissive material by the metal coating 222 was further enhanced and there occurred little peeling-off of the metal coating 222 from the metal substrate 221.

The invention accomplished by the inventors was specifically described above on the basis of the embodiment, but the present invention is not limited to the above embodiment. For example, the method of fixing the cathode to the lead rod is not limited to the brazing, but a variety of other methods can also be employed for the fixing.

As described above, the discharge tube according to the present invention is one in which the metal substrate at the cathode tip portion, containing the electron-emissive material or impregnated with the electron-emissive material, is covered in the predetermined portion by the coating of the refractory metal and the electron-emissive material is prevented from being evaporated in the coating part during the operation of the discharge tube. On the other hand, since the tip portion of the cusp of the metal substrate is exposed without being covered by the coating, electron emission is promoted from the electron-emissive material having diffused to the tip portion. For this reason, electrons can be efficiently emitted at relatively low temperatures and it is thus feasible to stabilize the discharge and also suppress the evaporation of the electron-emissive material, thus lengthening the lifetime. When the thickness of the coating covering the metal substrate is controlled in the range of not less than 0.02 μm nor more than 5 μm, it is feasible to effectively prevent the evaporation of the electron-emissive material by the coating and make the coating resistant to peeling-off from the metal substrate, thereby realizing lengthening of the lifetime of the discharge tube.

It is apparent from the above description of the present invention that the present invention can be modified in various ways. Such modifications can be contemplated without departing from the gist and scope of the present invention and all improvements obvious to those skilled in the art are intended to be embraced in the scope of claims which follow.

What is claimed is:

1. A discharge tube in which a cathode with a cathode tip portion being fixed to a lead rod and an anode opposed to said cathode tip portion are encapsulated in a discharge gas atmosphere to effect arc discharge, wherein said cathode tip portion comprises:

a metal substrate of an impregnated type in which a porous, refractory metal is impregnated with an electron-emissive material or a sintered type in which a refractory metal containing an electron-emissive material is sintered; and a coating of a refractory metal covering a predetermined portion in a surface of said metal substrate and having a thickness of not less than 0.02 $\mu$m nor more than 5 $\mu$m, wherein said metal substrate has a cusp pointed toward said anode, and wherein a tip portion of said cusp of said metal substrate is exposed without being covered by said coating.

2. The discharge tube according to claim 1, wherein said coating has the thickness of not less than 0.2 $\mu$m nor more than 3 $\mu$m.

3. The discharge tube according to claim 1, wherein the refractory metal making said metal substrate is at least either of tungsten, molybdenum, tantalum, and niobium.

4. The discharge tube according to claim 1, wherein said electron-emissive material, which is contained in said metal substrate or with which said metal substrate is impregnated, is at least either of barium, calcium, strontium, lanthanum, yttrium, and cerium.

5. The discharge tube according to claim 1, wherein said refractory metal making the coating is at least either of iridium, rhenium, osmium, ruthenium, tungsten, hafnium, and tantalum.

* * * * *